US010085534B1

(12) United States Patent
Quijada et al.

(10) Patent No.: US 10,085,534 B1
(45) Date of Patent: Oct. 2, 2018

(54) SUITCASE SYSTEM

(71) Applicants: Michael Quijada, San Marcos, CA (US); John Phillips Paladino, San Marcos, CA (US)

(72) Inventors: Michael Quijada, San Marcos, CA (US); John Phillips Paladino, San Marcos, CA (US)

( * ) Notice: Subject to any disclaimer, the term of this patent is extended or adjusted under 35 U.S.C. 154(b) by 0 days.

(21) Appl. No.: 15/600,895

(22) Filed: May 22, 2017

(51) Int. Cl.
*A45C 5/03* (2006.01)
*A45C 13/02* (2006.01)
*A45C 13/10* (2006.01)

(52) U.S. Cl.
CPC ..... *A45C 13/02* (2013.01); *A45C 5/03* (2013.01); *A45C 2013/026* (2013.01); *A45C 2013/1015* (2013.01)

(58) Field of Classification Search
CPC ..... A45C 13/02; A45C 5/03; A45C 2013/026; A45C 2013/1015
See application file for complete search history.

(56) References Cited

U.S. PATENT DOCUMENTS 895,209 A * 8/1908 Smith ..... B65D 7/12 220/509
943,719 A * 12/1909 Vick ..... B65D 9/34 211/184
2,479,269 A 8/1949 Schneider
2,697,631 A * 12/1954 Miller ..... B60P 7/14 211/184
3,549,301 A * 12/1970 Ericson ..... A47B 88/9418 312/194
3,656,651 A * 4/1972 Hage ..... A47B 88/90 220/533
3,656,786 A * 4/1972 Larson ..... A47F 3/12 211/184
3,696,472 A * 10/1972 Perina ..... A44B 18/0003 24/406
4,389,133 A * 6/1983 Oberst ..... A47B 47/06 220/532
4,854,432 A 8/1989 Carpenter et al.
5,244,268 A 9/1993 Derrickson
5,379,893 A 1/1995 Ruiz
6,283,287 B1 9/2001 Carl
7,779,976 B2 8/2010 Mangano
9,051,083 B1 * 6/2015 Davis ..... B65D 25/06
2007/0089954 A1 4/2007 Eardley et al.
2013/0307214 A1 11/2013 Grolier et al.
2014/0326560 A1 11/2014 Bergh et al.

OTHER PUBLICATIONS

TrekPak Foam Inserts for Pelikan 1510 Cases, https://www.amazon.com/TrekPak-Foam-Insert-Pelican-Cases/dp/B01CV0JAQ6/ref=sr_1_2?ie=UTF8&qid=1486579086&sr=8-2&keywords=pelican+dividers, visited Feb. 8, 2017.

* cited by examiner

*Primary Examiner* — Tri Mai
(74) *Attorney, Agent, or Firm* — Mark Wisnosky

(57) ABSTRACT

A novel suitcase system comprising a case, partitions and a tool that is an aid in repositioning the partitions is described. The inside of the case and the partitions are lined or covered with hook or loop material such that once in contact are held together. The tool is used to easily break the bond between the hook and loop material and reposition or remove the partitions. The case also includes a flexible top that when opened can be folded or rolled into a pouch incorporated on the outside of the case. Pouches that include a strip of hook or loop material may be removably attached to the inside walls of the case or to the sides of the partitions.

7 Claims, 13 Drawing Sheets

SUITCASE SYSTEM

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Technical Field

The invention relates to a suitcase, set of dividers, and, a tool to facilitate repositioning the dividers.

Related Background Art

Suitcases with dividers for creating compartments for holding specialty items are known. Those that allow repositioning of the the dividers are less well known. Typically, the repositionable divider systems use hook and loop material on flaps that connect to the dividers. Other system that include a plurality of slots sized to fit the thickness of the dividers are also used. The difficulty of either of the prior art systems is that they are difficult to reposition, the flap material curls and frays after extended use and they do not allow complete flexibility as to positioning dividers in multiple positions. There is a need for an improved suitcase and divider system.

BRIEF SUMMARY OF THE INVENTION

The present invention discloses a suitcase, set of dividers and a specialized tool for easily, removing, repositioning the dividers, and installing the dividers within the case. The case is lined with hook and/or loop material and the dividers are covered with hook and/or loop material such that the edges of the dividers when placed in contact with the walls of the case or other dividers are removably attached. A channel shaped tool is used to both install and remove the dividers within the case. This enables use of a particular strongly attaching hook and loop material to hold the dividers firmly in place while still retaining the ability to easily reposition the dividers. The dividers may be covered with hook material and the walls of the suitcase lined with loop material or vice versa. In another embodiment a portion of the dividers are covered in hook material and a second set of dividers are covered in loop material such that the dividers may be attached by their edges to both the walls of the suitcase as well as to other dividers providing ultimate flexibility in creating compartments within the suitcase. In another embodiment the top of the suitcase is made of a flexible material such as screen, cloth or plastic film that zippers shut and when opened may be folded or rolled into a pocket included on the outside shell of the suitcase. In another embodiment only the edges of the dividers are covered with hook or loop material. The preferred embodiment is a suitcase system that includes a suitcase with a flexible top, the suitcase lined on the interior with loop material, planar dividers sized to fit within the suitcase also lined with loop material, and having hook material on their vertical edges, a u-shaped tool with a first tapered end and a second blunt end, that allow easy placement, removal and repositioning of the dividers within the suitcase thereby creating custom sized compartments within the suitcase. Another preferred embodiment further includes a pouch having a flap lined on at least one side with hook material that can be attached to the partitions within the suitcase or to the walls of the suitcase.

The specific examples are not intended to limit the inventive concept to the example application. Other aspects and advantages of the invention will be apparent from the accompanying drawings and detailed description.

DETAILED DESCRIPTION OF THE INVENTION

Figure 1:
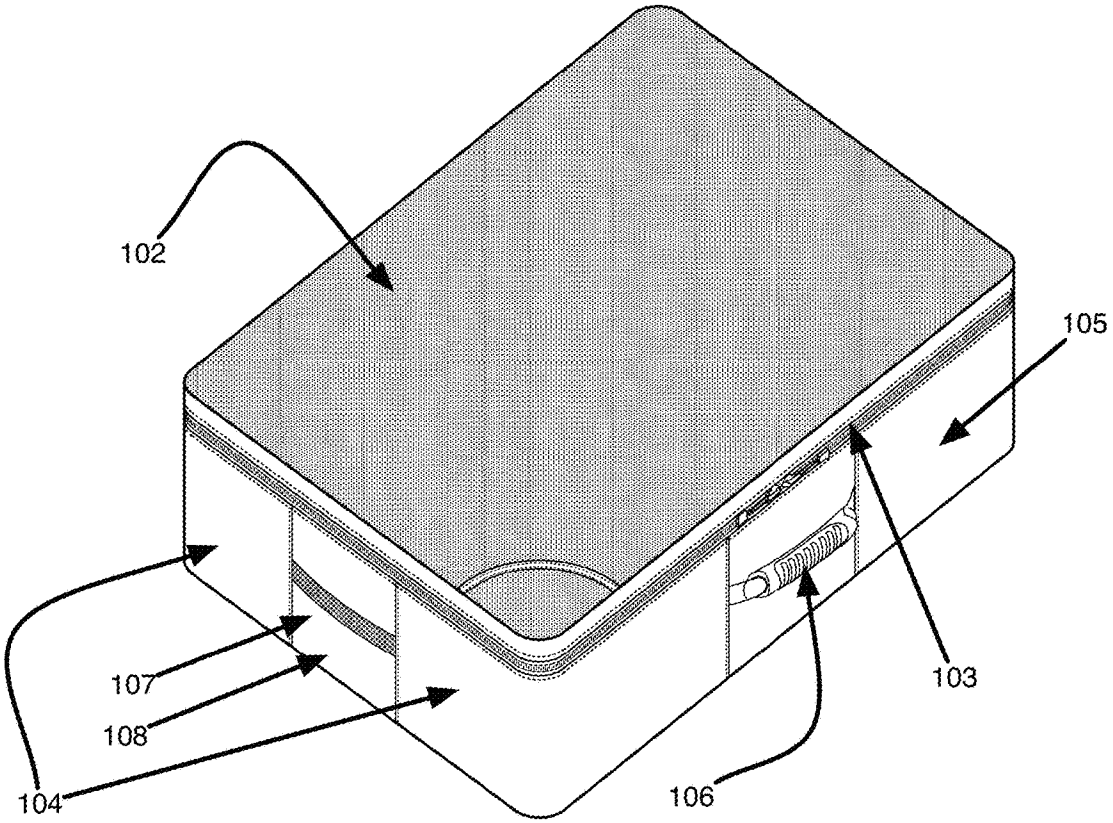
FIG. 1 shows the outside of the invented suitcase system.

FIG. 1 is a view of the suitcase 101 in a closed position. The suitcase includes a top 102. In the preferred embodiment the top is made of a flexible material such as screen, cloth, or plastic film the top is closed using a zipper 103 or a hook and loop strip in place of the zipper. The case includes a handle 106 on the front 105 and another handle 107 on the first end 104. In one embodiment, the handle 107 on the first end is located in an indentation 108 such that the case may be stood on the first end 104 either for carrying and storage or for use as compartmentalized stand as is seen in later Figures. In another embodiment the handle 107 and the first end are comprised of flat material and stitched such that the handle and the end form a flat surface that allows the case to be stood upright on the first end 104.

Figure 2A:
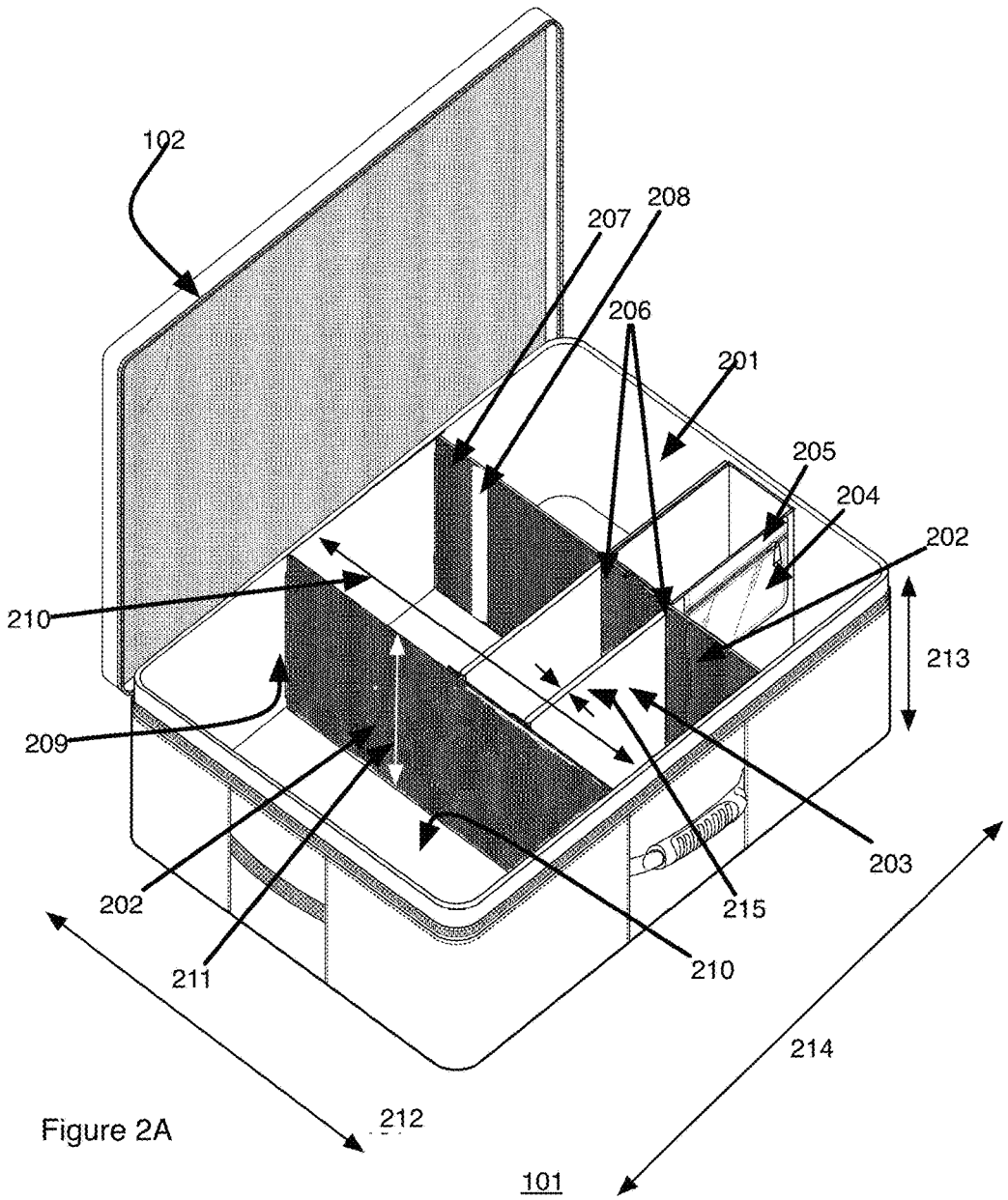
FIG. 2A shows the interior of an embodiment of the suitcase system.

FIG. 2A shows the suitcase with the top 102 in an open position. The interior of the suitcase is divided into compartments using partitions 202, 203. The partitions are covered with a hook material, shown here as the dark covered partition 202, or covered with a loop material, shown here as the white partitions 203. The interior walls of the suitcase 201 are also lined with either hook or loop material. In the example the walls are lined with loop material. In one embodiment, the covering on the partitions extends around the edges such that when the edges make contact with either a suitcase wall or another partition the partition latches onto the surface with the oppositely lined surface. In the example shown, the partition 202 is covered with a hook material and attaches to the wall 201, lined with a loop material at the edge 209. Similarly, the partition 203, covered with a loop material, attaches to the partition 202, covered with a hook material, at the edges 206. In the preferred embodiment the floor 210 of the interior of the case 101 is not lined so that neither hook nor loop material attaches at the floor and the partitions 202, 203 can be removed by disconnecting at the edges 206, 209 using the tool described in FIGS. 4-7. Note the connection is at the edges at both ends of the partitions even though only one end is labeled in the Figure. In another embodiment the partition 202 or the walls may be lined with alternating hook 207 or loop 208 material such that a second partition may be attached whether it is lined with hook or loop material by positioning at the appropriate location 207, 208. The partitions have a length 210, a height 211 and a thickness 215. In the preferred embodiment the length 210 of at least a portion of the partitions is the same as the width 212 of the case and the height 211 of the partitions is approximately the same as the height 213 of the case. The width places a constraint upon the width of the channel in the tool described in FIG. 4. Another embodiment (not shown) further includes partitions that are approximately the length 214 of the case such that by selection of a set of partitions of varying lengths the case may be subdivided into compartments along both the width and length of the case. Another embodiment includes a detachable pouch 204. The pouch includes a region 205 that is covered with hook or loop material and may be removably attached to a partition as shown. In the preferred embodiment, the region 205 is covered with hook material as the interior walls of the case and the planar walls of the dividers are covered with loop material.

Figure 2B:
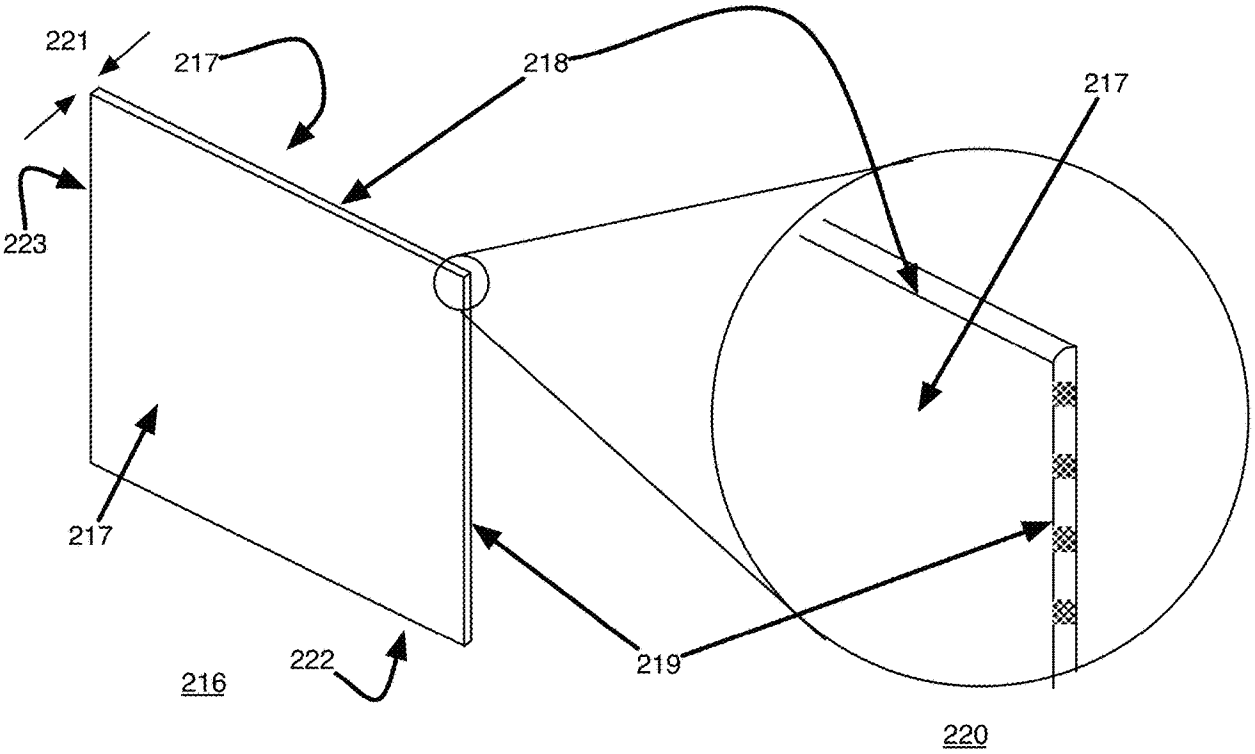
FIG. 2B shows two views of the partitions of the suitcase system.

In the preferred embodiment all of the interior walls of the suitcase are covered with loop material and the partitions are constructed as shown in the two views 216, 220 of FIG. 2B. In this preferred embodiment the partitions are planar, rectangular structures having two planar surfaces 217 (the back side planar surface is not visible in the Figure). The partitions have a thickness 221, a bottom edge 222, a top edge 218, a first vertical or side edge 223 and a second vertical or side edge 219. The first view 216 shows a full view of a partition and the second view 220 shows a magnified view of the corner region of the partition. In this preferred embodiment the planar surfaces 217, the bottom edge 222 and the top edge 218 are all covered with loop material and the vertical edges 223, 219 are covered with hook material. The vertical edges are thereby removably held against both the vertical faces 217 of other partitions and against the walls of the suitcase when the vertical edges contact such surfaces. The partitions may be removed and repositioned using the channel shaped tool as shown in FIGS. 4-7 below. An advantage of the preferred embodiment is that when assembled all of the exposed surfaces are covered with the loop material which is, as is known in the art, a softer material that is less likely to scratch surfaces of the contents of the case than is the counterpart hook material.

Figure 3:
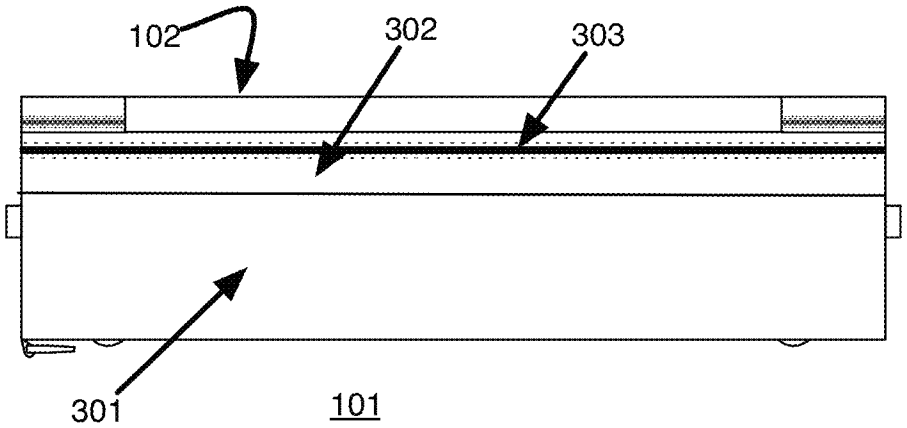
FIG. 3 shows the back of the suitcase including a closable pouch to hold the top of the suitcase.

In another embodiment the vertical edges 223, 219 are covered in loop material and the remaining surfaces 217, 218, 222 and the suitcase walls are all covered in hook material. FIG. 3 shows the back 301 of the suitcase 101. In a preferred embodiment, the back includes a closable pouch into which the top 102 may be rolled or folded and tucked into the pouch 302 and the pouch may be closed using the closure 303. The closure 303 may be a zipper, opposing strips of hook and loop material or snaps or similar means as are known in the art. In another embodiment the pouch 302 is made of an elastic material and the closure is a slot in the pouch 302 material that snaps shut on release and holds any contents such as the rolled or folded top 102 in place by the tension from the elastic material of the pouch 302.

Figure 4A:
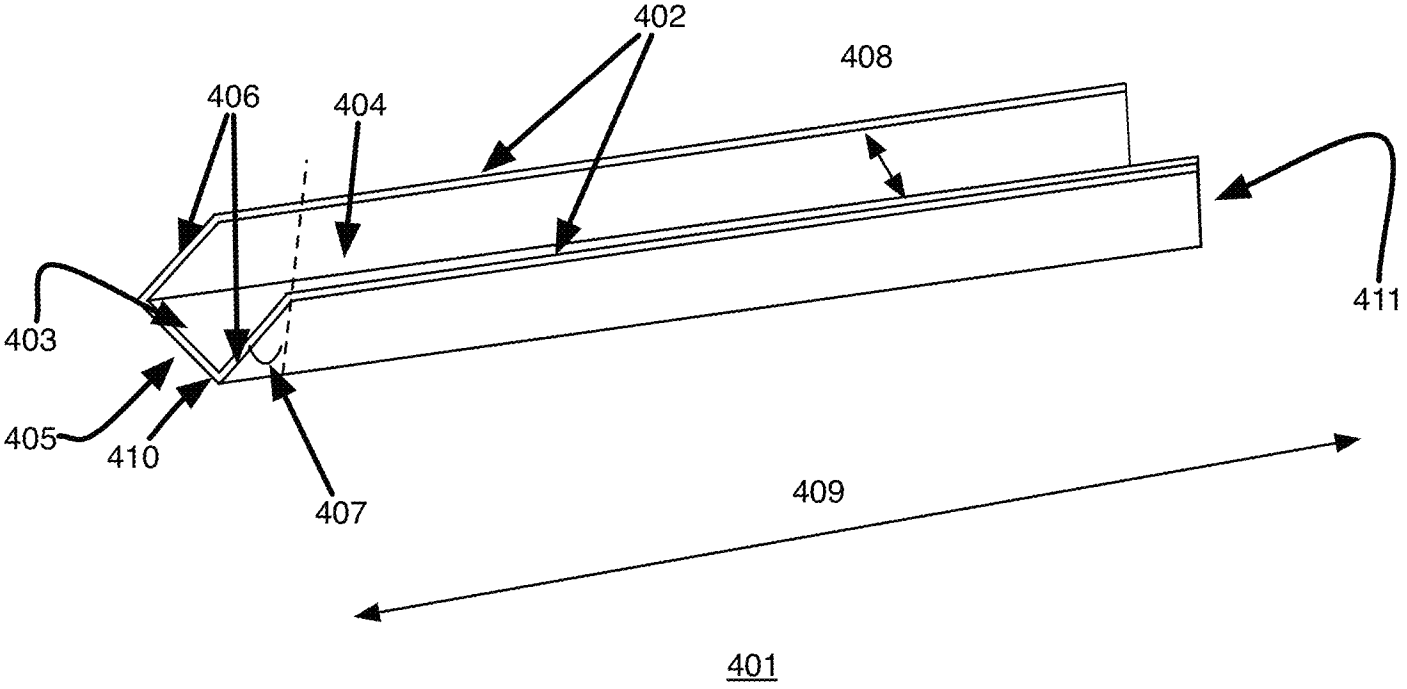
FIG. 4A shows the channel shaped tool used to reposition the partitions of the suitcase system.
Figure 4B:
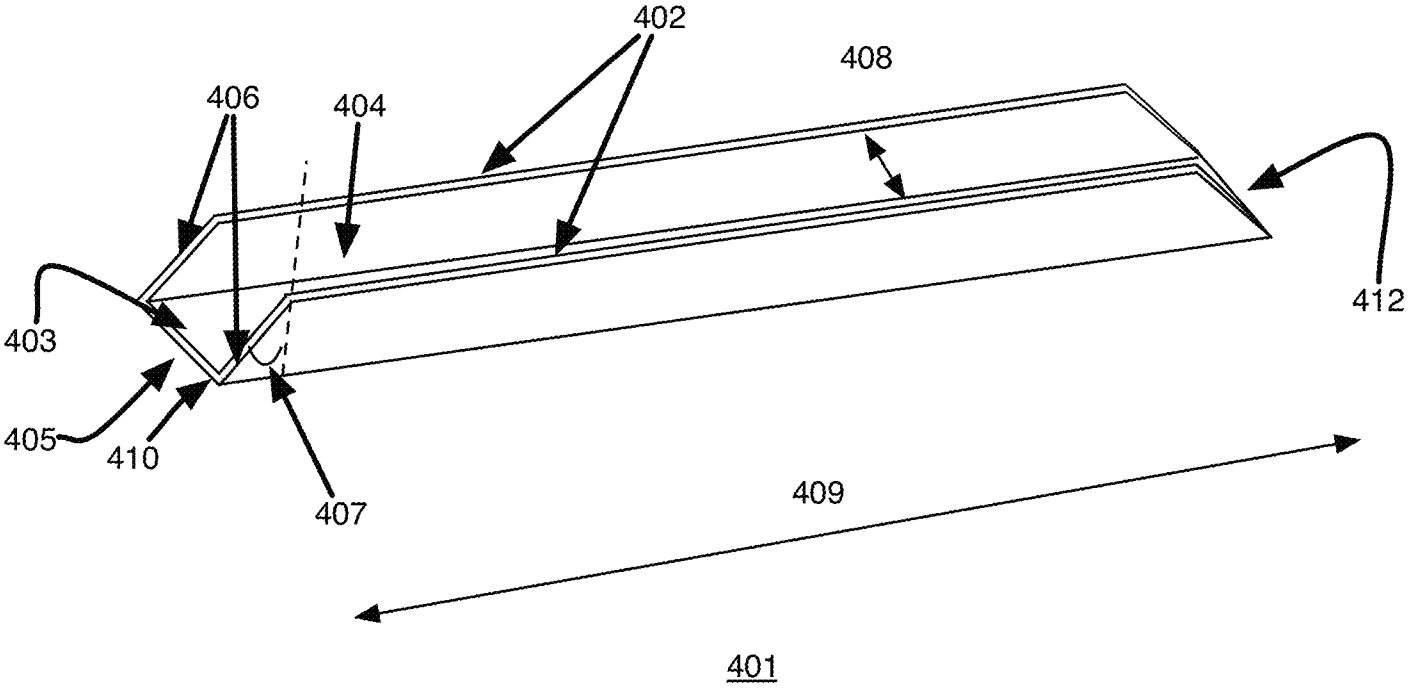
FIG. 4B shows a second embodiment of the channel shaped tool used to reposition the partitions of the suitcase system.

FIG. 4A shows the tool 401 that is part of the invented suitcase system. The tool 401 is an elongated channel shaped device having a first surface 403 and two walls 402 attached to the base surface 403 such that the three surfaces form a channel 404. The width of the channel 408 is selected such that the tool will fit over the edges of the partitions and is therefore slightly larger than the thickness 215 (see FIG. 2) of the partitions. The tool has a length 409 that is selected to be larger than the height 211 (see FIG. 2) of the partitions such that the tool may be inserted at joined edges of the partitions and detach the partition from the wall of the suitcase or from another partition. The details of use of the tool are shown in subsequent Figures. A first end 405 has walls 406 cut at an angle 407 from the vertical such that the end 405 of the tool tapers to a point as shown. The first end of the tool 406 is tapered to a point and and the second end of the tool 411 is blunt to allow for the user to push on this end while the tapered end engages and disconnects the joined edges of the partition. In another embodiment, shown in FIG. 4B, both the first end of the tool 405 and the second end of the tool 412 are tapered. In another embodiment, not shown, the tool is a U-shaped tool and the walls 402 have a rounded point of juncture 410 with the base 403.

Figure 5:
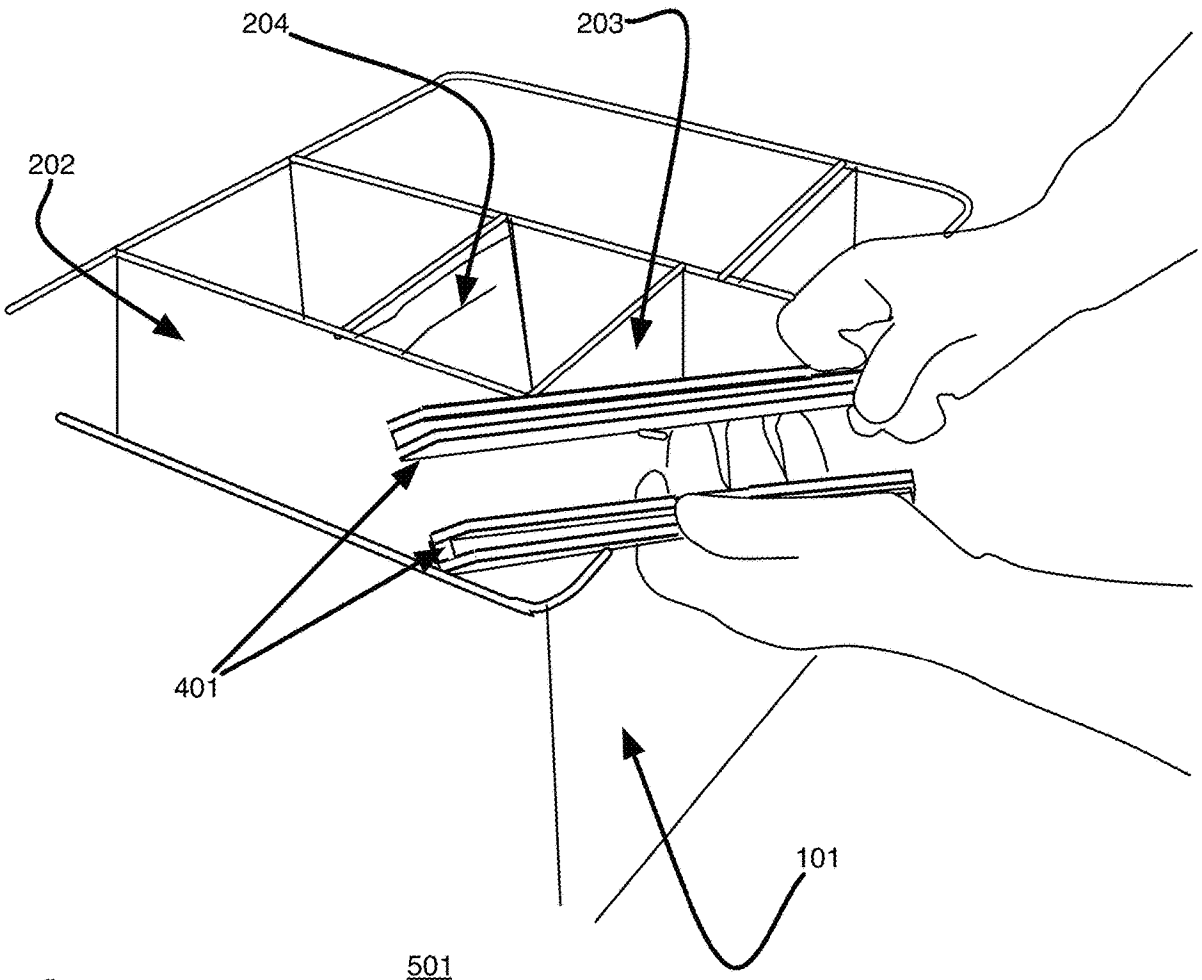
FIG. 5 shows a first frame of a sequence of using the tools to install, remove or reposition the partitions.
Figure 6:
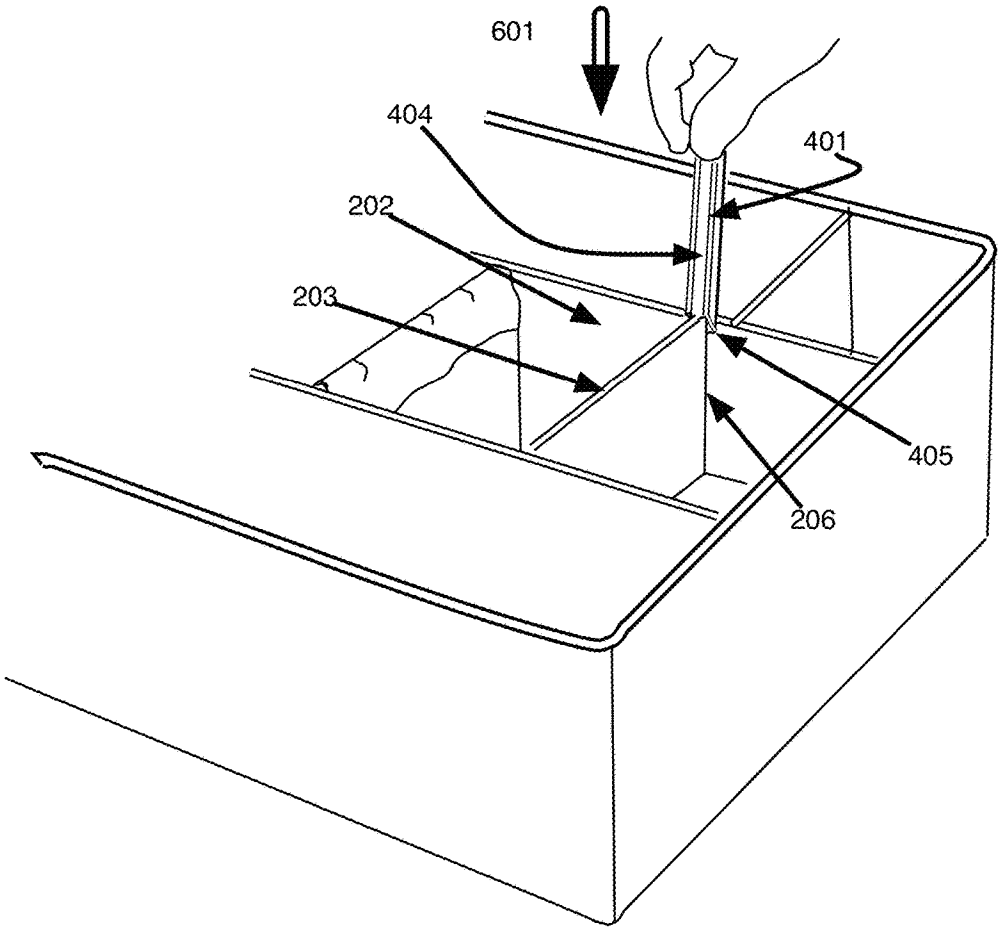
FIG. 6 shows a second frame of using the tools to install, remove or reposition the partitions.
Figure 7:
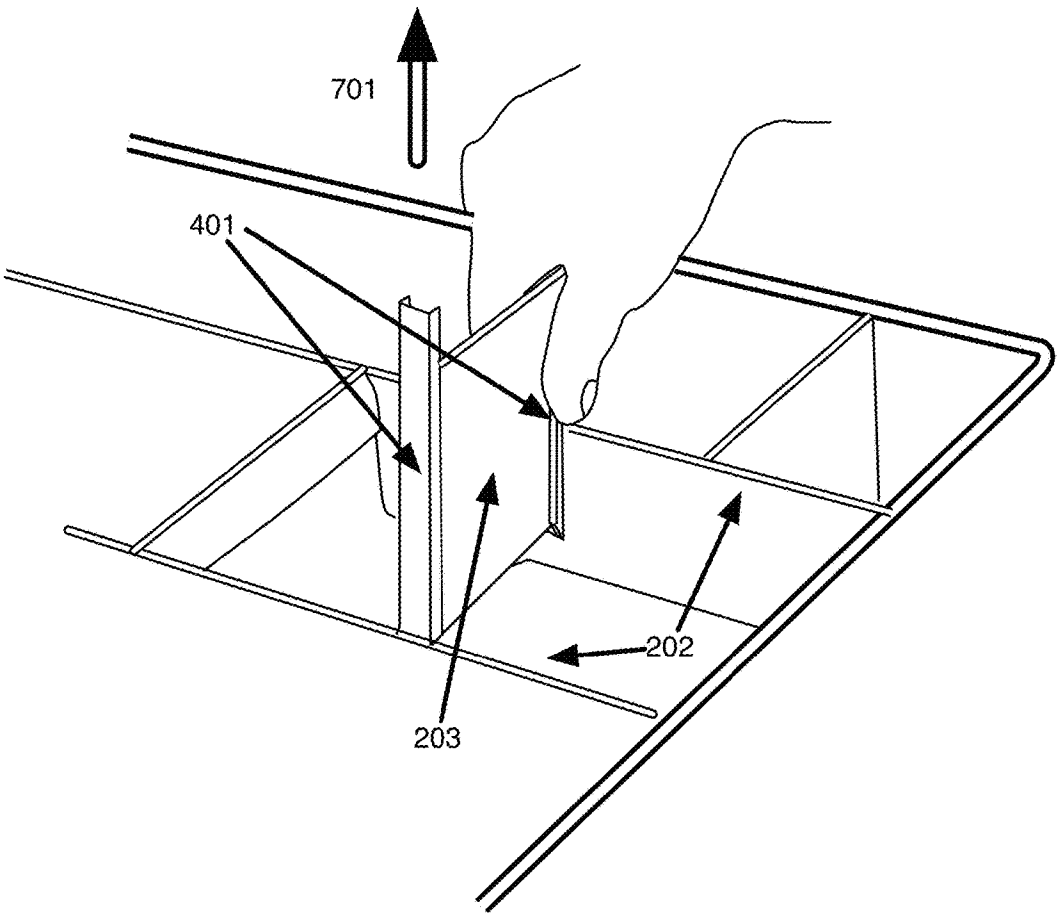
FIG. 7 shows a third frame of using the tools to install, remove or reposition the partitions.
Figure 8:
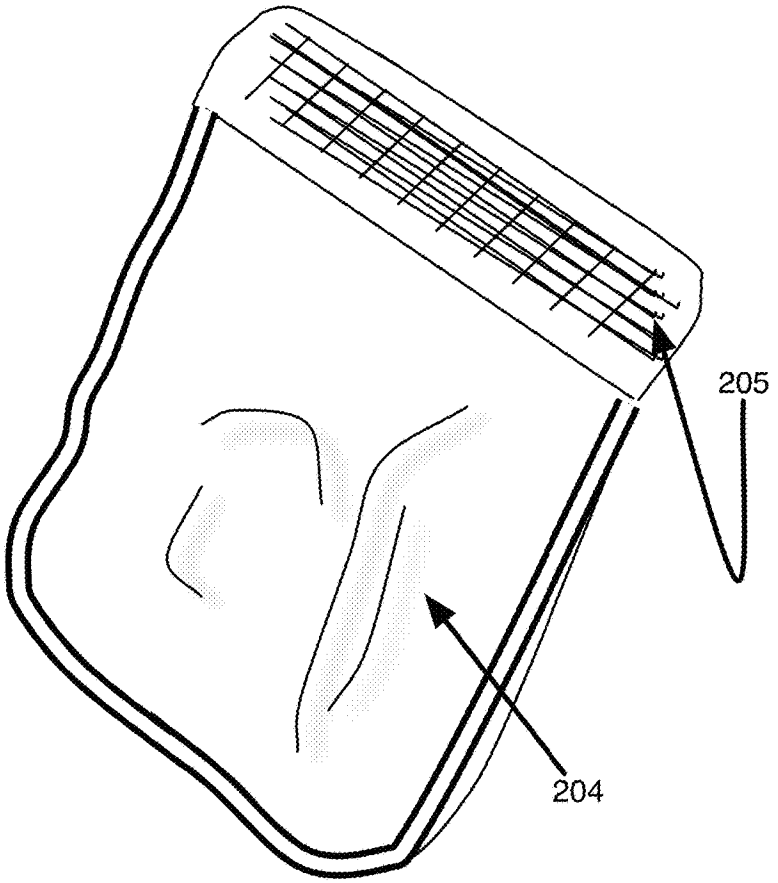
FIG. 8 shows details of a repositionable pouch used with the suitcase system.

FIGS. 5-7 show a sequence of images that display use of the tool as part of the suitcase system. A user would use a pair of tools 401 to reposition or remove partitions 202, 203 that are attached at either the walls of the case 101 such as partition 202 or attached to other partitions as for partition 203. The same tool 401 may be used regardless of the type of covering, hook or loop, on the partition or wall of the case. Referring to FIG. 6 the tool 401 is positioned with its end 405 at the junction 206 where a partition is attached to either another partition (as shown in FIG. 6) or to an inside wall of the case. The tool is aligned such that the edge of the partition 203 wits within the channel 404 on the tool. Once positioned, the user pushes down 601 on the tool thereby forcing the tool down the junction 206. The tool is pushed downward until the end of the tool touches the base of the interior of the case and disconnects the first partition 203 from the second partition 202. A second tool is similarly inserted at the opposite edge of the partition 203 and once both edges are thusly disconnected the partitioned may be lifted 701 from the case as shown in FIG. 7. The partition 203 is thereby removed from the case. The partition is reinserted by reversing the operation. The partition 203 with the tools 401 in place along each edge is inserted into the desired location within the case and then the tools 401 are lifted to remove them from the edges. This action exposes the hook or loop material at the edge of the partition 203 and the hook or loop material then latches onto the complimentary material on either the wall of the case or on another partition. FIG. 8 shows the details of the repositionable pouches included in an embodiment of the invention. The pouch includes a bag portion 204 and a flap 205. The flap 205 includes either hook or loop material and will removably attach to a partition or wall of the case that is lined with hook or loop material that is complimentary to that of the material on the flap.

Figure 9:
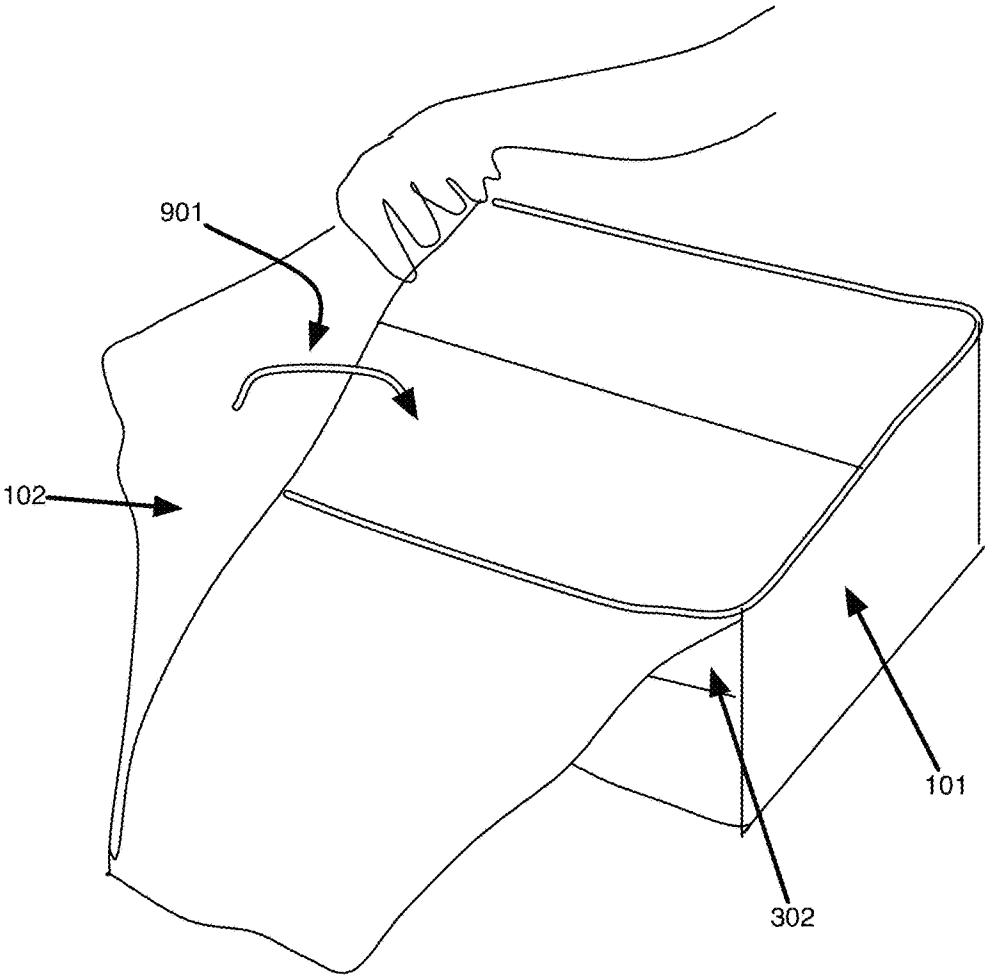
FIG. 9 is a first of a sequence showing folding the top of the suitcase into a pouch on the back of the suitcase.
Figure 10:
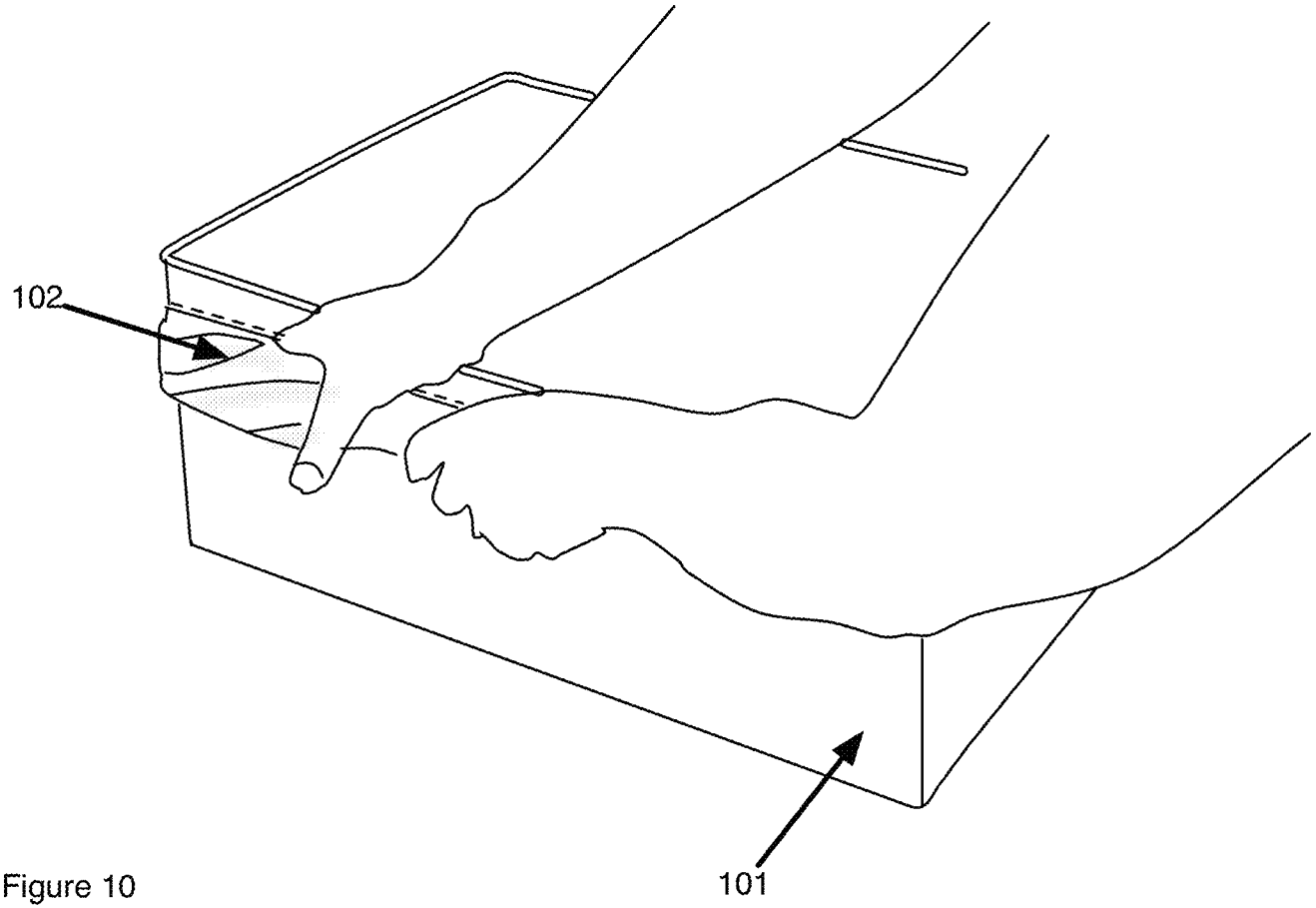
FIG. 10 is the second of a sequence showing folding the top of the suitcase into a pouch on the back of the suitcase.

FIGS. 9 and 10 show the operation of folding and or rolling the flexible top 102 of the case into the pocket 302 provided on the back of the case 101. The top 102 is opened as shown in FIG. 9 and then may be folded 901 as shown or rolled and tucked into the pocket 302 as shown in FIG. 10. In the preferred embodiment the top is comprised of a porous material that enables air flow such that, for example wet contents of the suitcase can dry out even with the suitcase closed.

Figure 11:
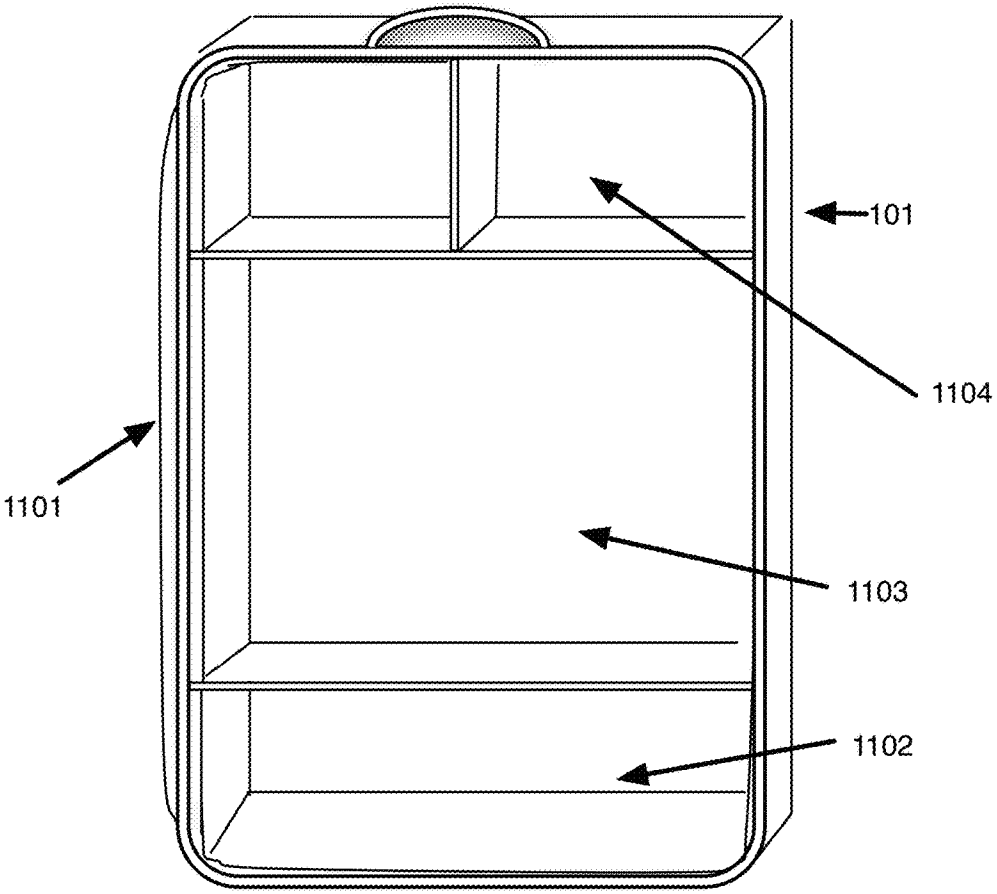
FIG. 11 shows the suitcase system as used a a vertical storage container.

In another feature of the case shown in FIG. 11, once the top is tucked away into the pouch 1101 the suitcase 101 may be stood on end and the partitions form individual compartments 1102, 1103, 1104. The configuration is especially useful for triathletes with individual compartments for shoes 1102, clothing 1103 and bike helmets 1104 or swim goggles.

SUMMARY

A novel suitcase system comprising a case, partitions and a tool that is an aid in repositioning the partitions is described. The inside of the case and the partitions are lined or covered with hook or loop material such that once in contact are held together. The tool is used to easily break the bond between the hook and loop material and reposition or remove the partitions. The case also includes a flexible top that when opened can be folded or rolled into a pouch incorporated on the outside of the case. Pouches that include a strip of hook or loop material may be removably attached to the inside walls of the case or to the sides of the partitions.

We claim:

1. A suitcase system comprising:

a. a case having four sides a bottom and an openable top, an interior and an exterior, and, the interior of the case having a base and vertical walls, the walls coated with either hook or loop material, and, b. a plurality of removable rectangular partitions, each of the plurality of the partitions having a top edge, a bottom edge, two planar faces, and two vertical edges, and, each of the plurality of partitions having a height, length, and thickness, and, each of the plurality of partitions are covered with either hook or loop material, and, c. a tool for repositioning the partitions, said tool comprising an elongated U-shaped channel, the length of the tool longer than the height of the plurality of partitions and a width of the channel slightly larger than the thickness of the plurality of partitions, and a first end of the tool tapered to a point, wherein the point may be inserted between the vertical wall of the case and the vertical edge of the plurality of partitions, and, when pushed down the edge of the partition fits within the channel of the tool and the partition is detached from the vertical wall of the case.

2. The suitcase system of claim 1 wherein a second end of the tool is blunt.

3. The suitcase system of claim 1 wherein a second end of the tool is tapered to a point.

4. The suitcase system of claim 1, wherein, in the plurality of partitions, a first portion of the partitions are covered with hook material and a second portion of the partitions are covered with a loop material such that when edges of the the first portion of partitions are pressed against the walls of the second portion of the partitions, the edges are removably attached to the walls, and may be detached from the walls by insertion of the tapered end of the tool between the edge and the wall and pushing the tool down the edge such that the edge fits within the channel of the tool and when inserted along the full height of the partition detaches the edge of the first portion of partitions from the wall of the second portion of the partitions.

5. The suitcase system of claim 1 wherein the vertical walls of the suitcase are covered with loop material, the planar surface, the bottom edge and the top edge of each of the plurality of partitions are covered with loop material and the vertical edges of the plurality of partitions are covered with hook material.

6. The suitcase system of claim 1 wherein the vertical walls of the suitcase are covered with hook material, the planar surface, the bottom edge and the top edge of each of the plurality of partitions are covered with hook material and the vertical edges of the plurality of partitions are covered with loop material.

7. The suitcase system of claim 1 wherein the openable top is comprised of a porous material with a porosity selected such that air can flow to the interior of the suitcase even with the top in a closed position.

* * * * *